US005971179A

United States Patent [19]

Christmas et al.

[11] Patent Number: 5,971,179

[45] Date of Patent: Oct. 26, 1999

[54] NON-REFILLING DEVICES

[75] Inventors: Paul Michael Christmas, Dumlane; Andrew Robert Blair, Greenock; Robert Bell, Falkirk, all of United Kingdom

[73] Assignee: Daniel Montgomery & Son Limited, United Kingdom

[21] Appl. No.: 08/776,833

[22] PCT Filed: Jul. 24, 1995

[86] PCT No.: PCT/GB95/01733

§ 371 Date: Feb. 18, 1997

§ 102(e) Date: Feb. 18, 1997

[87] PCT Pub. No.: WO96/04179

PCT Pub. Date: Feb. 15, 1996

[30] Foreign Application Priority Data

Jul. 26, 1994 [GB] United Kingdom ..... 9415051

[51] Int. Cl.[6] ..... B65D 49/04

[52] U.S. Cl. ..... 215/21; 215/18; 215/22

[58] Field of Search ..... 215/14, 20, 21, 215/22, 18

[56] References Cited

U.S. PATENT DOCUMENTS

| | | | |
|---|---|---|---|
| 2,064,002 | 12/1936 | Herzog | 215/21 X |
| 2,122,595 | 7/1938 | Stonebraker | 215/21 |
| 3,073,470 | 1/1963 | Greene | 215/22 |
| 3,329,294 | 7/1967 | Bichon | 215/20 |
| 4,217,988 | 8/1980 | Mills et al. | 215/21 |
| 4,258,854 | 3/1981 | Wright | 215/21 |
| 4,449,637 | 5/1984 | Snedker | 215/21 |
| 4,497,415 | 2/1985 | Delonghi | 215/21 |
| 5,419,446 | 5/1995 | Cox et al. | 215/21 |

FOREIGN PATENT DOCUMENTS

| | | | |
|---|---|---|---|
| 698653 | 11/1984 | Canada | 215/22 |
| 571070 | 11/1993 | European Pat. Off. . | |
| 79431 | 10/1962 | France | 215/21 |
| 2248984 | 5/1975 | France . | |
| 2377335 | 8/1978 | France | 215/22 |
| 3445122 | 6/1985 | Germany | 215/21 |
| 21438 | of 1915 | United Kingdom | 215/22 |
| 426382 | 3/1935 | United Kingdom | 215/22 |
| 1178237 | 1/1970 | United Kingdom | 215/22 |
| 2000099 | 1/1979 | United Kingdom | 215/21 |
| 2026428 | 2/1980 | United Kingdom . | |
| 2236998 | 4/1991 | United Kingdom | 215/22 |
| 2244048 | 11/1991 | United Kingdom | 215/14 |

*Primary Examiner*—Sue A. Weaver

*Attorney, Agent, or Firm*—Gifford, Krass, Groh, Sprinkle, Anderson & Citkowski, P.C.

[57] ABSTRACT

The invention relates to a non-refilling device for insertion in the neck portion (3) of a container for liquids for example, fine spirits, the device comprising a sleeve member (4) adapted to be a secure fit within the neck portion (3), a one-way valve arrangement (6, 8), a pouring member (10) and a closure member (16, 20). While the device is being applied to the neck portion of the filled container, all the above components are maintained in an assembled condition by engagable members (28, 32) on the closure member (16) and the pouring member (10). When the container is opened normally, the action of unscrewing the closure member (16, 20) is adequate to overcome the action of the engagable members (28, 32) so that the container may be opened and resealed in a conventional manner.

13 Claims, 4 Drawing Sheets

FIG. 9
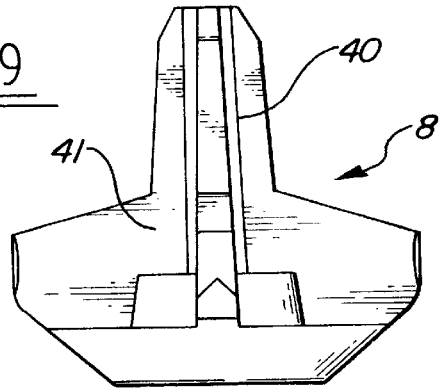
FIG. 10
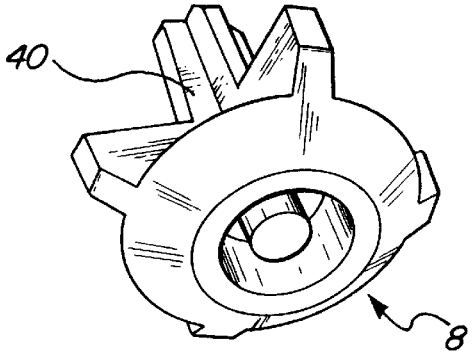
FIG. 11
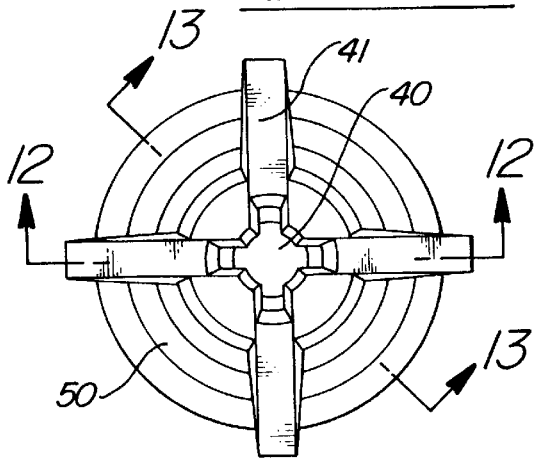
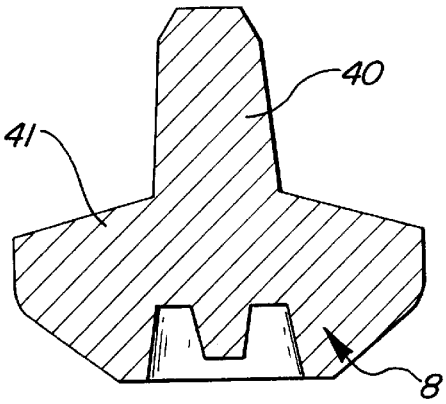
FIG. 12
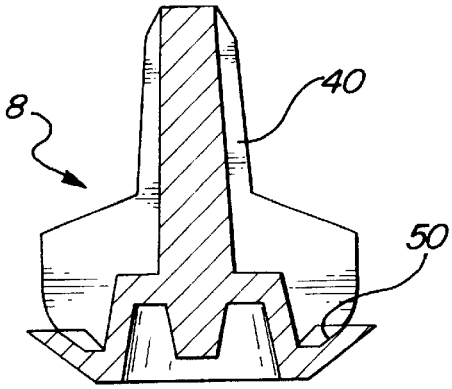
FIG. 13

NON-REFILLING DEVICES

FIELD OF THE INVENTION

The invention is concerned with improvements in or relating to non-refilling devices adapted to be secured within the outlet of a container for liquid, for example as an insert in the neck of a bottle.

DESCRIPTION OF THE RELEVANT PRIOR ART

Devices to prevent refilling of bottles, particularly bottles intended to contain spirits, are well known but although such devices may make it extremely difficult to introduce replacement liquid into the bottle, the manufacture and design of such devices may be complicated and therefore the devices, however desirable, may be expensive to produce.

It is an object of the present invention to provide a device which is effective in use and avoids an excessive cost penalty.

It is a further object of the invention to provide a device that may be applied to a container neck in a combined condition and in a single operational step, thus to improve the speed of operation and the efficiency and versatility of the container filling and closing line.

SUMMARY OF THE INVENTION

The invention provides a non-refilling device for insertion within a neck portion of a container for liquids, the device comprising a tubular assembly adapted to be received at least substantially within said neck portion and having engagement means provided on an external surface thereof adapted for firm engagement with an internal surface of said neck portion, said assembly including a sleeve means a lower end portion of which is directed in use towards the interior of said container, said sleeve means being provided with a valve seat surface, there being provided a valve member adapted to seat against said seat surface in a closed position, said assembly further comprising a pouring member received in a force- or interference-fit within an upper, open end portion of said sleeve means and provided with an annular pouring lip, the device being further provided with a container closure means including an annular sealing surface adapted in use to be in sealing engagement with said container neck portion, said annular sealing surface surrounding an annularly arranged projecting means adapted to engage removably with engagement means provided on the tubular assembly when the device is in a fully assembled condition, the construction and arrangement being such that, prior to use, the device is self-maintaining in said fully assembled condition in which each component thereof is engaged with an adjacent component prior to and during the application of the device to a container neck portion.

Advantageously, said closure means may comprise a cap and an insert secured within the cap, said sealing surface and said annularly arranged projecting means being provided on said insert.

Preferably, said annularly arranged projecting means engages removably with the annular pouring lip of said pouring member.

Conveniently, said pouring member may be provided with a centrally disposed recessed inner portion adapted to receive and locate said valve member, said recessed inner portion being itself received in removable engagement with a second annularly arranged projection means on said closure means.

Advantageously, said valve member may be provided with an axially extending stem portion adapted to be received within a recess provided in the pouring member.

Preferably, said pouring member may comprise at least one zone of weakness in its construction, said zone being arranged to fracture on the application of abnormal pressure associated with tampering prior to an unauthorised attempt to refill the container.

Advantageously, the sleeve means may be provided with a plurality of annular, substantially radially extending, flanges adapted to be deformed when the sleeve inserted into the container neck, to provide a wedging effect rendering the insertion effectively permanent. Conveniently, the flanges may be spaced apart by differing distances therebetween. Advantageously, one or more flanges, preferably including the uppermost of the flanges, may be of larger diameter than the remainder.

Conveniently, the external surface of the pouring member is provided with annular ribs which are adapted to soften during insertion into the sleeve member and to re-harden in a distorted condition enhancing the permanency of the engagement with the internal surface of the sleeve member.

BRIEF DESCRIPTION OF THE DRAWINGS

There will now be described an example of a device according to the invention. It will be understood that the description which is to be read with reference to the drawings is given by way of example only not by way of limitation.

In the drawings:

FIGS. 9 and 10 are a side view and a perspective view respectively of a valve member;

FIG. 11 is an underneath plan view of the valve member; and

FIGS. 12 and 13 are sections taken on lines XII—XIII and XIII—XIII respectively of FIG. 11;

DETAILED DESCRIPTION OF THE INVENTION

Figure 1:
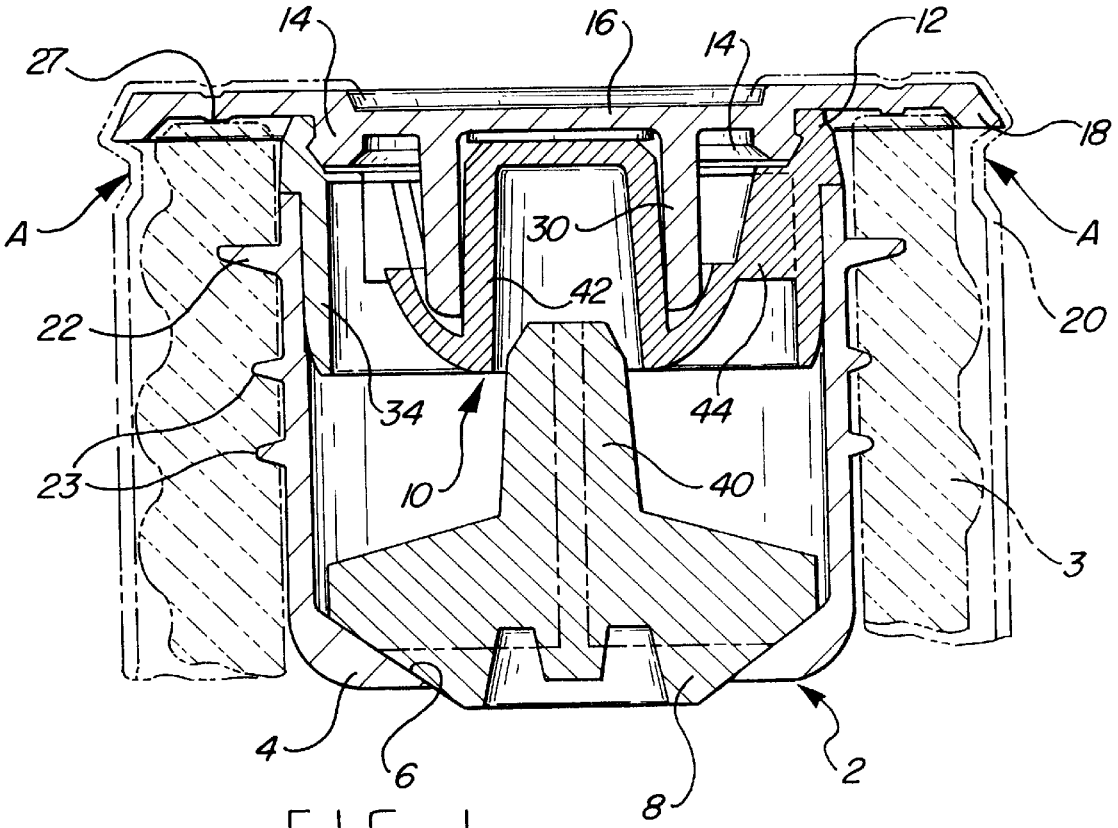
FIG. 1 is a longitudinal sectional view through a device according to the invention.

The device, 2, according to the invention is intended to be assembled as shown in FIG. 1 with its components in an interengaging relationship such that the device may be applied to a neck portion 3 (shown in chain-dotted line) of a spirits bottle, while the parts comprising the device are maintained in a fully assembled condition in which each part present as a component in the device is held in engagement with an adjacent one of the component parts so that the entire device may be applied to a container neck portion in a single operational movement.

It should be noted that the single movement is similar to that conventionally used in the application of a cap to a container neck, and therefore there is a marked increase in efficiency when that movement can be used to apply all the closure parts in one operational step instead of two or more.

Subsequently to its application to the neck portion 3, the device is operable to enable a closure member thereof to be removed from and replaced on the remainder of the device as will be explained.

The device 2 comprises a tubular sleeve member 4 having a valve seat surface 6 at the lower portion thereof against which is seated a valve member 8.

Received in permanent engagement in the upper portion of the sleeve member 4 is a pourer member 10, a pouring lip 12 of which is adapted to engage, but in a removable manner, with an annular projection 14 of a sealing member 16. Outer edge portions 18 of the member 16 are held captive in a formable foil cap 20 which is clenched about the member 16 at A.

Figure 2:
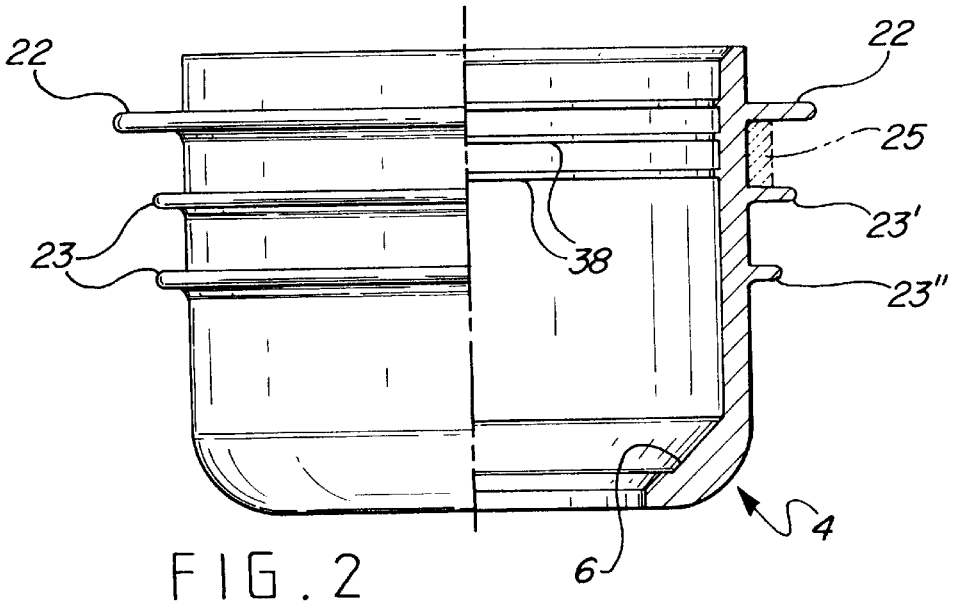
FIG. 2 is a side view partly in section of a sleeve member of the device of FIG. 1, including a minor modification thereof.

FIG. 2 shows the sleeve member 4 which in the present example is moulded from low density polyethylene and is provided with annular engagement flanges 22, 23 that extend generally radially from the outer surface at selected levels. In the present example, three such flanges are provided in total, the upper one of which, 22, is of a greater diameter than the flanges 23. FIG. 2 also shows at the right-hand side thereof an arrangement in which three flanges 22, 23' and 23" are of decreasing width the smallest 23" being free-standing and the flanges 22 and 23' being joined at four equidistantly spaced regions by a web member 25 if enhancement of the rigidity of the flanges is deemed advantageous. In another modification, the lower flange 23" may be used as a wiping blade to remove traces of liquid from the surface of the glass that may otherwise interfere with the secure fit of the member 4 in the neck 3.

However, all the flanges may, if preferred, be of the same diameter and may, for example, total three, four or five in number.

Figure 3:
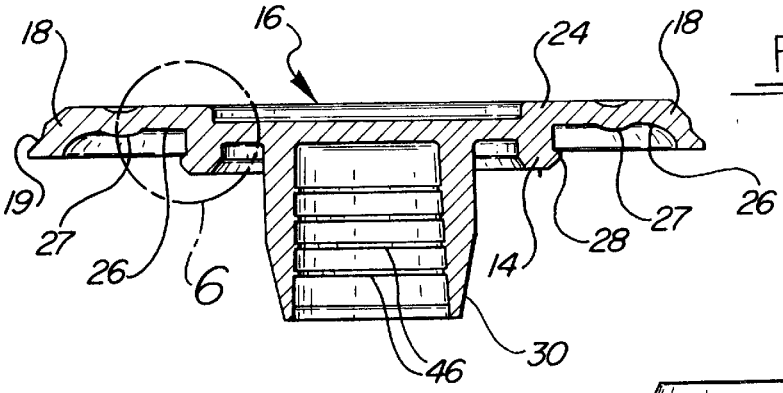
FIG. 3 is a sectional view of a sealing insert of the device.
Figure 6:
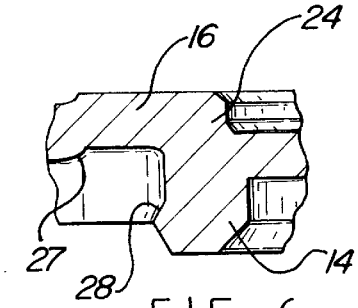
FIG. 6 is a fragmentary view of a portion of FIG. 3 to an enlarged scale.
Figure 7:
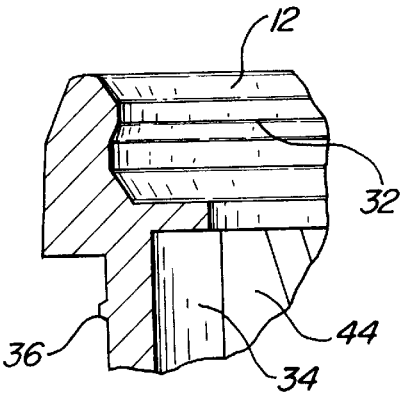
FIG. 7 is a fragmentary view of a portion of FIG. 5 to an enlarged scale.

When the fully assembled device is inserted within the bottle neck 3 the flanges 22, 23 are forced upwardly and inwardly so as to form a effectively immovable insert in the open mouth of the bottle. The flange 22, being of larger diameter than the remainder of the flanges 23, provides an enhanced grip. The bottle is in fact closed by contact of the sealing member 16 with an upper edge surface of the neck portion 3. The sealing member 16 as shown in FIGS. 3 and 6 comprises a disc-like body member 24 having its outer edge portions 18 formed into a downwardly and outwardly turned flange 19. A sealing surface 26 intended to contact the neck portion 3 surrounds the first projecting means 14 which has an outwardly facing ridge 28. A shallow ridge 27 is formed in the surface 26, conveniently provided by an annular undulation formed in the member. This feature may be found to provide a degree of resilience in the member 16 which is capable of absorbing a portion of the force receiving during application of the closure to the bottle neck. This acts to reduce any tendency for the closure to be deformed or to release from the bottle lip, thus compromising the efficiency of the seal formed. It will be understood that additional sealing ribs may be provided if thought necessary. Within the circumference of the first projecting means is a second, deeper, projecting means 30. The purpose of these projecting means will be described below.

Figure 4:
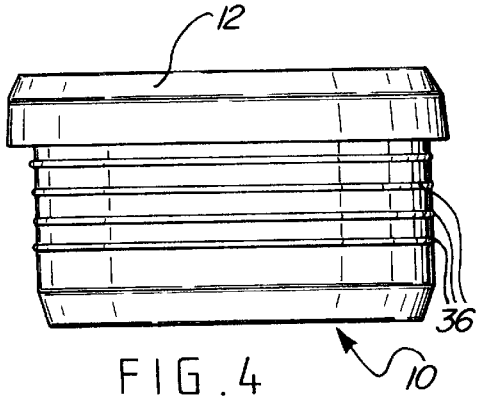
FIGS. 4 and 5 are full and sectional side views respectively of a pourer member of the device.
Figure 5:
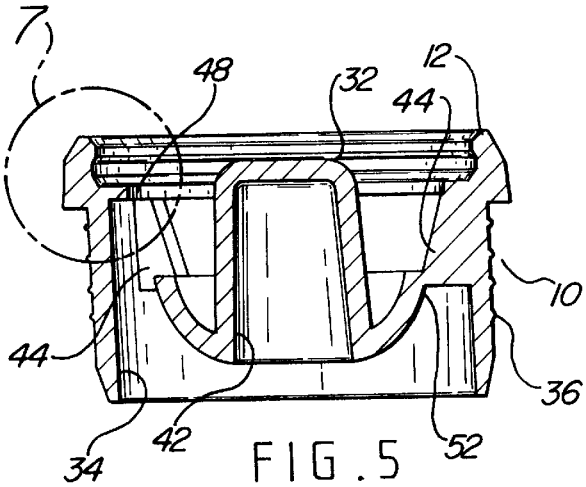

FIG. 4 illustrates the pourer member 10, while FIG. 5 shows a sectional view in which an annular internal rib 32 on the lip 12 can be seen. The member 10 is moulded from polystyrene in the present example but it will be understood that any suitable rigid material may be used that has the necessary heat-resistant properties for example a thermosetting plastics material or a ceramic. When the component parts of the device are engaged together prior to its application to the neck portion 3 of a filled bottle of, for example, spirits, the ridge 28 being of a diameter slightly greater than that of the annular rib 32, when pressed axially into overlapping contact with the latter in assembly, becomes held in positive engagement therewith. Thus, the sealing member 16 is held in a self-maintaining assembled condition with respect to the other component members of the device, i.e. the pourer member and the valve means, whilst the device is applied to the neck portion 3 in an axial direction. However, in normal use by the consumer, the actions of removing and re-applying on of the closure means (sealing member 16 and the cap 20) with respect to the pour member 10 are carried out in an at least part-helical movement with normal manual force which is sufficient to permit disengagement of the rib 32 and the ridge 28. In an alternative modification, as depicted in FIGS. 14 through 17, the ridge 28' and the rib 32' may be formed in a helical manner, conveniently at the same inclination as that of the thread formation on the bottle neck 3, so that the turning action of removing the closure facilitates the ready disengagement of the ridge 28' and the rib 32'.

Provided on the external surface of a body portion 34 of the member 10 are a plurality, in this case four, of narrow ribs 36 which enhance the permanence of the fit between the pourer member 10 and the sleeve member 4 into which it is forced. The ribs 36 engage with corresponding ribs 38 formed on the interior surface of the sleeve member 4 (see FIG. 2) in such a manner that dis-assembly is in effect impossible under most conditions. The result is that the valve member is captive but movable within the space enclosed by the members 4 and 10.

Figure 8:
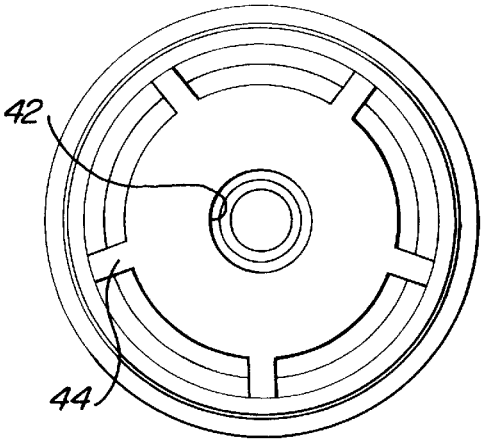
FIG. 8 is an underneath plan view of the pourer member.
Figure 14:
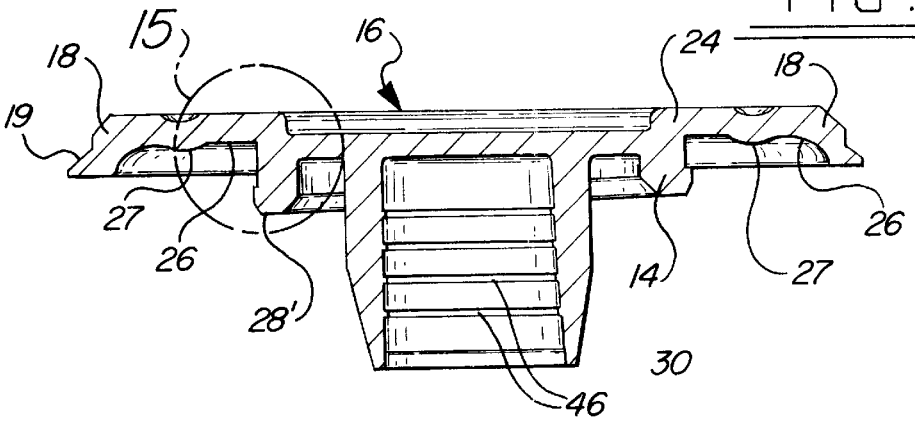
FIGS. 14 and 15 show a modification of the sealing member depicted in FIGS. 3 and 6, the modification being directed to a helically designed shallow ridge.
Figure 15:
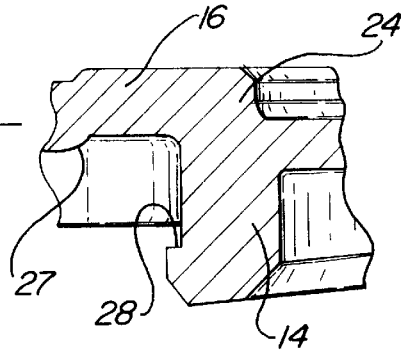
Figure 16:
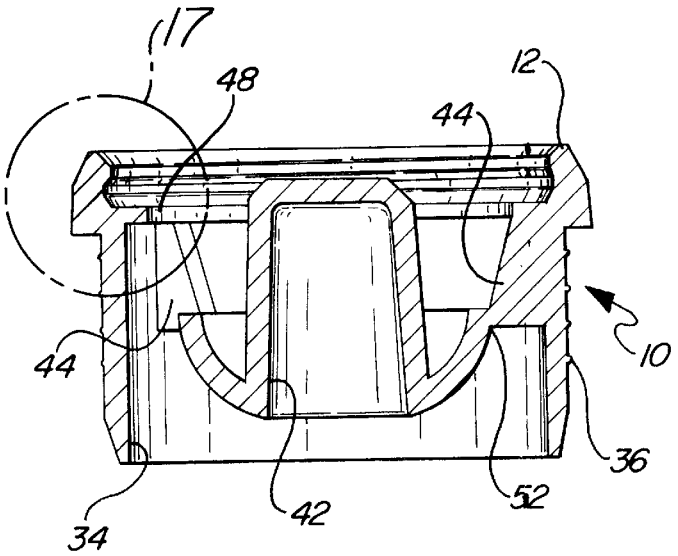
FIGS. 16 and 17 show a modification of the pourer member depicted in FIGS. 5 and 7, the modification being directed to a helically designed internal rib.
Figure 17:
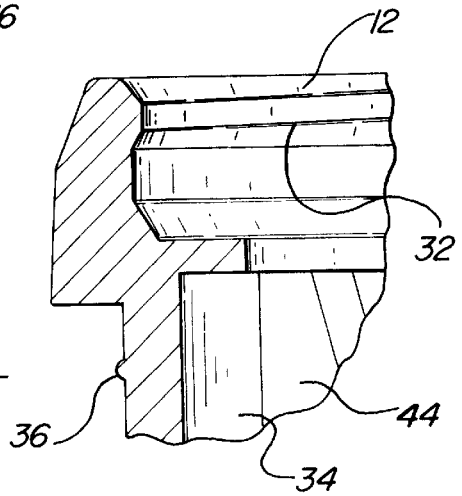

In order to ensure correct alignment of the movable valve member 8 with the seating surface 6, the member 8 is provided with a stem portion 40 having stabilising vanes 41 and which is received in a loose fit within a recessed inner portion 42 of the pourer member 10. The portion 42 is linked with the tubular portion by five link members 44 (see FIG. 8 for example) and, when the device is assembled, is itself received within the annular projecting means 30. This acts to stabilise the assembly in a lateral direction to resist the possibility of the components of the device becoming off-centre or out of alignment at any time after assembly. Ribs 46 enhance the locating action of the projecting means 30 on the portion 42, which in turn ensures proper location of the valve member 8.

The valve member 8, as can be seen in FIG. 1, is in contact with the valve seat surface 6 when the bottle is in a generally upright condition. This seating effect may be enhanced by the provision of a saucer-like portion 50 around the member which in practice traps a small quantity of liquid adding to the effective weight of the valve member. Thus, re-filling is rendered extremely difficult, although inversion of the bottle in normal use causes the valve member to fall away from the seat surface 6 and permit a normal pouring out action for the genuine contents.

If a person wishes to re-fill the bottle with replacement liquid, any attempts to remove the device will probably involve the application of a considerable amount of force. It will be noticed that zones of weakness are provided in the member 10 at 48 and 52 so that the application of force causes the plastics material to fracture at these zones and the resulting damage and at least partial detachment of the inner portion 42 indicates to a user that tampering has taken place. Where the inner portion 42 actually breaks away from the member 10, the valve member 8 is exposed to view. While this is a positive indication that tampering has taken place, the visual effect may be enhanced if the materials from which the member 10 including the portion 42 and the valve member are made are of differing colours.

Various modifications may be made within the scope of the invention as defined in the following claims.

We claim:

1. A non-refilling device for insertion with a neck portion of a container for liquids, the device comprising a tubular assembly adapted to be received at least substantially within said neck portion and having engagement means provided on an external surface thereof adapted for firm engagement with an internal surface of said neck portion, said assembly including a sleeve means a lower end portion of which is directed in use towards the interior of said container, said sleeve means being provided with a valve seat surface, there being provided a valve member adapted to seat against said seat surface in a closed position, said assembly further comprising a pouring member received in a force- or interference-fit within an upper, open end portion of said sleeve means and provided with an annular pouring lip, the device being further provided with a container closure means including an annular-sealing surface adapted in use to be in sealing engagement with said container neck portion, said annular sealing surface surrounding an annularly arranged projecting means adapted to engage removably with engagement means provided on the tubular assembly when the device is in a fully assembled condition, the construction and arrangement being such that, prior to use, the device is self-maintaining in said fully assembled condition in which each component thereof is engaged with an adjacent component prior to and during the application of the device to a container neck portion.

2. A device as claimed in claim 1, wherein said closure means comprises a cap and an insert secured within the cap, said sealing surface and said annularly arranged projecting means engaging removably with the annular pouring lip of said pouring member.

3. A device as claimed in claim 1, wherein a ridge provided upon one of said annular pouring lip and said first mentioned annularly arranged projecting means, said ridge being adapted to engage with a rib provided upon the other of said annular pouring lip and said first mentioned annularly arranged projecting means.

4. A device as claimed in claim 3, wherein said ridge is formed as a part-helical interengaging means.

5. A device as claimed in claim 1, wherein said pouring member is provided with a centrally disposed recessed inner portion adapted to receive and locate said valve member, said recessed inner portion being itself received in removable engagement with a second annularly arranged projection means on said closure means.

6. A device as claimed in claim 5, wherein said valve member is provided with an axially arranged stem portion adapted to be received within said recessed portion of the pouring member.

7. A device as claimed in claim 1, wherein the sleeve means is provided with a plurality of annular, substantially radially extending, flanges adapted to be deformed when the sleeve inserted into the container neck, to provide a wedging effect rendering the insertion effectively permanent.

8. A device as claimed in claim 7, wherein the flanges are spaced apart by differing distances therebetween.

9. A device as claimed in claim 7, wherein one of the flanges is of larger diameter than the remainder.

10. A device as claimed in claim 7, wherein the uppermost of the flanges is of larger diameter than said remainder.

11. A device as claimed in claim 7, wherein the flanges are reinforced by the provision of web members therebetween.

12. A device as claimed in claim 1, wherein the external surface of the pouring member is provided with annular ribs formed of a material which softens during insertion into the sleeve member and rehardens in a distorted condition enhancing the permanency of the engagement with the internal surface of the sleeve member.

13. A device as claimed in claim 1, wherein at least one zone of weakness is provided in the structure of the pouring member, said zone fracturing to display damage caused by tampering with for purposes of re-filling the container.

* * * * *

UNITED STATES PATENT AND TRADEMARK OFFICE

CERTIFICATE OF CORRECTION

PATENT NO. : 5,971,179

DATED : Oct. 26, 1999

INVENTOR(S) : Paul Michael Christmas, et al.

It is certified that error appears in the above-identified patent and that said Letters Patent are hereby corrected as shown below:

Page 1, Foreign Application Priority Data - Replace " Jul. 26, 1994" with Jul. 30, 1994--

Page 1, Foreign Application Priority Data - Replace " 941591" with --9415454.9--

Column 2, line 48,49 - Replace " lines XII - XIII and XIII - XIII respectively" with --lines 12-12 and 13-13 respectively--

Column 6, line 1 - After "ridge" insert --is--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*